United States Patent [19]

Carroll et al.

[11] 4,355,731

[45] Oct. 26, 1982

[54] EGG SUPPORTING TRAY

[75] Inventors: James C. Carroll, Bartlesville, Okla.; Paul R. Lefebvre, Hopkinsville, Ky.

[73] Assignee: Phillips Petroleum Company, Bartlesville, Okla.

[21] Appl. No.: 243,680

[22] Filed: Mar. 16, 1981

[51] Int. Cl.[3] ..... B65D 1/36; B65D 85/32

[52] U.S. Cl. ..... 217/26.5; 229/2.5 EC

[58] Field of Search ..... 217/26.5, 26; 229/2.5 EC

[56] References Cited

U.S. PATENT DOCUMENTS

| | | | |
|---|---|---|---|
| 2,662,659 | 12/1953 | Putnam | 217/26.5 |
| 3,360,150 | 12/1967 | Schechter | 217/26.5 |
| 3,451,577 | 6/1969 | Nurick | 217/26.5 |
| 3,771,712 | 11/1973 | Richards | 229/2.5 EC |
| 3,877,599 | 4/1975 | Morris | 217/26.5 |

*Primary Examiner*—Allan N. Shoap

*Attorney, Agent, or Firm*—French, Hughes and Doescher

[57] ABSTRACT

An egg supporting tray is provided which has a plurality of egg pockets. Each egg pocket is formed by four posts which are interconnected by ribs. Each surface of the four posts, which forms a part of an egg pocket, has a concave surface on the upper portion thereof and a ridge on the lower portion thereof. The ridge provides substantially four point contact for a small egg which improves washing and drying and reduces water spotting. The concave surface enables the egg supporting tray to accommodate large eggs.

6 Claims, 4 Drawing Figures

EGG SUPPORTING TRAY

This invention relates to an egg supporting tray. In one aspect this invention relates to an egg supporting tray which will accommodate different size eggs. In another aspect this invention relates to an egg supporting tray which provides minimum contact between the eggs and the tray when the eggs are small and which can also be utilized to support large eggs.

It is common practice to wash, grade and otherwise process eggs in large numbers. Eggs are relatively fragile articles and care must be excercised in the collecting, processing, and other handling in order to avoid damaging or breaking the eggs. A large variety of egg supporting trays for handling the eggs are known.

Egg supporting trays are commonly filled with eggs and stacked in crates. If the eggs do not fit properly into the egg pockets of the egg supporting trays (too high) breakage may occur when the trays are stacked. Many trays are thus designed for only a particular size egg. Use of different size trays presents economic disadvantages, impacts manufacturing facilities, and presents difficulties in shipping eggs.

It is desirable to minimize contact between the egg and the egg pocket of the tray. This allows better circulation of water for washing, better circulation of air for drying and prevents water spotting. Ridges in the egg pockets may be used to provide such minimum contact. However, such ridges may prevent large eggs from fitting properly into the egg pocket so as to prevent breakage when the trays are stacked.

It is thus an object of this invention to provide an egg supporting tray which will accommodate different size eggs. It is another object of this invention to provide an egg supporting tray which provides minimum contact between the eggs and the tray when the eggs are small and which can also be utilized to support large eggs.

In accordance with the present invention, an improved egg supporting tray is provided in which the egg pockets have a plurality of ridges which support small eggs and a plurality of concave surfaces which support large eggs. The plurality of ridges are located in the lower part of the egg pocket while the plurality of concave surfaces are located in an upper part of the egg pocket. Small eggs rest on the ridges and thus the advantages provided by the minimum contact of such ridges are provided for small eggs. Larger eggs rest on the concave surfaces. The contact area is increased with respect to the contact area on small eggs but the same size egg supporting tray can still be utilized.

Other objects and advantages of the invention will be apparent from the foregoing brief description of the invention and the claims as well as from the detailed description of the drawings in which:

Figure 1:
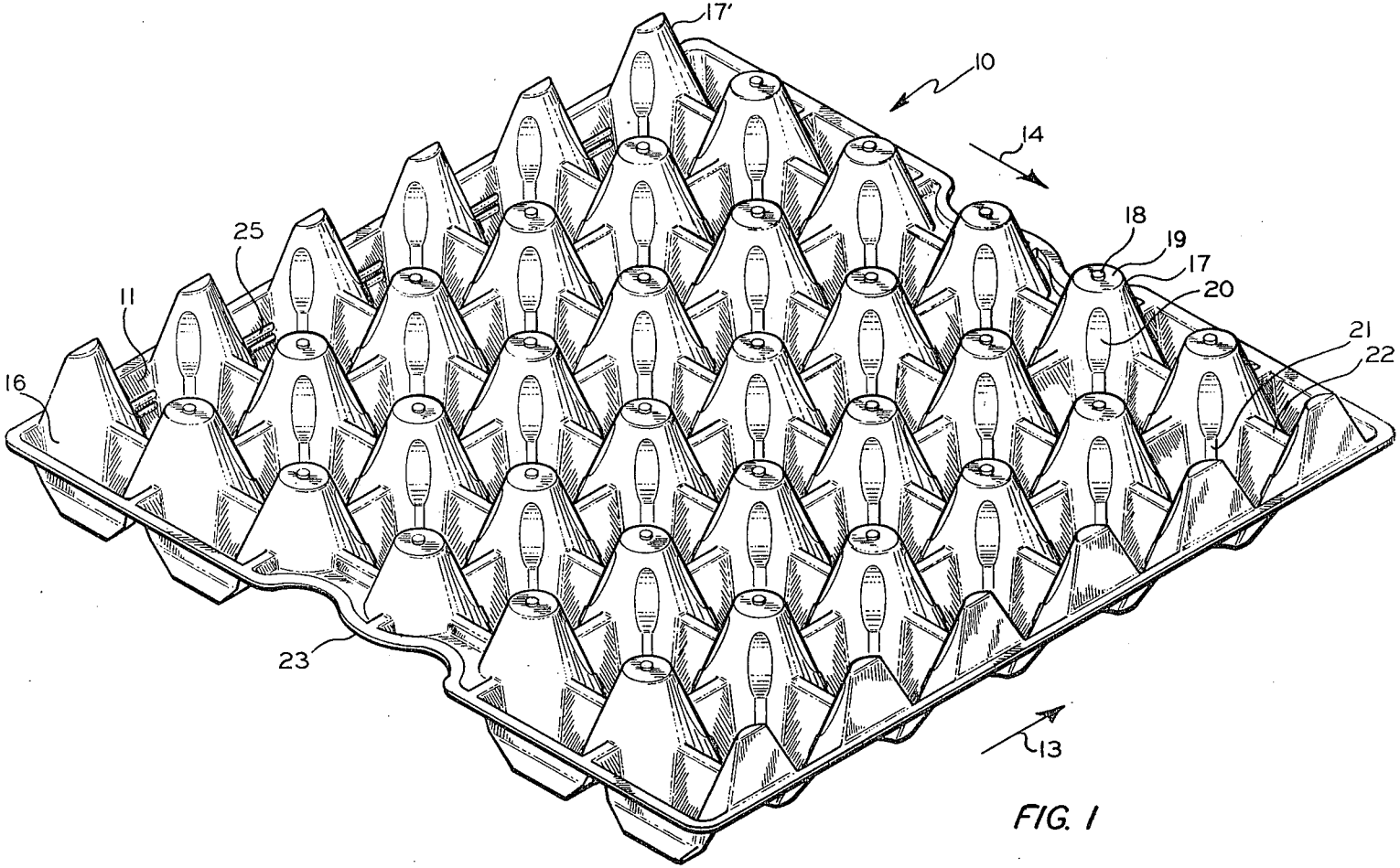
FIG. 1 is a pictorial view illustrating the egg supporting tray of the present invention.

Referring now to the drawings and in particular to FIG. 1, there is illustrated an egg supporting tray 10 which is formed from a sheet of stiff material. The egg supporting tray 10 has a generally rectangular periphery which is formed from the edges of the sheet from which the tray 10 is formed. A plane which contains the peripheral edges of the tray 10 will be utilized hereinafter as a reference plane for the description of the tray 10. Such a plane will be referred to hereinafter as the "plane of the periphery".

Figure 2:
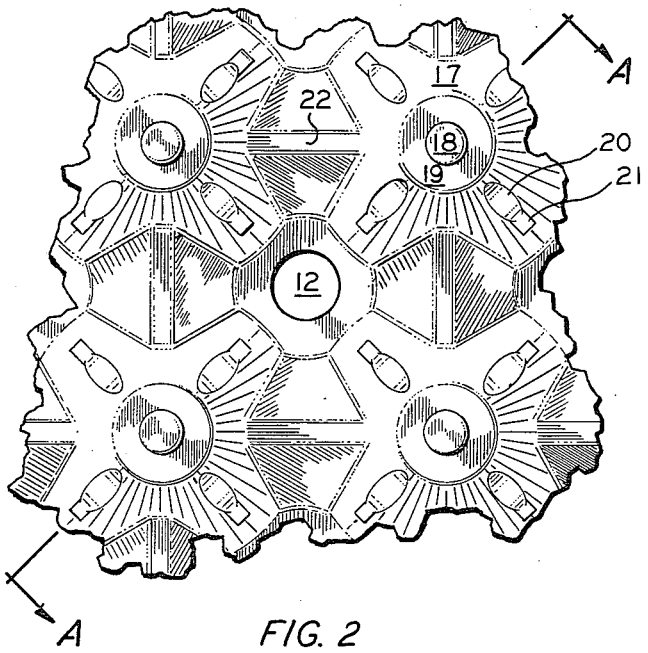
FIG. 2 is a plan view of a portion of the egg supporting tray illustrated in FIG. 1.

The tray 10 has a plurality of egg pockets 11. Each of the egg pockets 11 extends downwards below the plane of the periphery. As is shown in FIG. 2, each of the egg pockets 11 is preferably provided with a drainage hole 12 in the bottom thereof. As will more paticularly be pointed out hereinafter, it may be desirable to delete the drainage hole 12 under certain circumstances.

The egg pockets 11 are arranged in six substantially parallel rows running in the direction of the arrow 13 and by five substantially parallel columns transverse to the rows, running in the direction of the arrow 14. The first, second, fifth and sixth rows of the egg pockets 11 each begin with and end with a half egg pocket 16 which also extends below the plane of the periphery.

The walls of the egg pockets 11 are formed in part by a plurality of tapered (preferably substantially frustoconical) posts, such as the posts 17, which each extend upward above the plane of the periphery to an apex and downward below the plane of the periphery to a base. The apexes of the posts 17 are located in a plane which will be referred to hereinafter as the "first" plane. The bases are located in a plane which will be referred to hereinafter as the "second" plane. Four of the posts 17 are spaced equidistantly about each of the egg pockets 11. The posts 17 are arranged in seven substantially parallel rows running in the direction of arrow 13 and are also arranged in six substantially parallel columns running in the direction of arrow 14. The first and seventh rows of the posts 17 are half posts, such as 17', which are positioned along the opposite peripheral sides of the tray 10. The half posts 17' are also hollow and are tapered on one side only which faces the egg pockets 11 adjacent thereto.

All of the posts 17, except the half posts 17', preferably terminate at their upper ends in a knob 18 which has a transverse area smaller than the area of the openings 12 in the bottoms of the egg pockets 11. The knobs 18 are each surrounded by a shoulder 19 which together with the knob 18 has a transverse area larger than the opening 12. While the half posts 17' are not provided with a knob 18 and shoulder 19, it will be noted that preferably at least two of the posts 17, which are spaced about each of the egg pockets 11, terminate with a knob 18 and shoulder 19.

A second portion of the walls of the egg pockets 11 are formed by the plurality of ribs 22. The tops of the ribs 22 are substantially in the plane of the periphery. Each of the ribs 22 extends downwardly below the plane of the periphery between a pair of the posts 17 to the base of the posts 17 (the second plane). The ribs 22 are preferably tapered with respect to the center of the egg pocket 11, i.e., the ribs 22 are wider at the bottom near the base of the posts 17 than at the top near the plane of the periphery.

A concave surface 20 is formed on each surface of the posts 17 and 17' which form a part of the egg pockets 11 with the direction of concavity being towards the inside of the posts 17. The concave surface 20 extends along the surface of the posts 17 and 17' from a point near the apex of the posts 17 and 17' downward to a point close to but below the plane of the periphery. The curvature and width of the concave surface 20 is preferably such as will allow a large egg to contact substantially the entire concave surface 20. Four concave surfaces are present in each egg pocket 11.

An elongated ridge 21 projects from the surface of each of the posts 17 and half posts 17' which form a part of the egg pockets 11. Each elongated ridge 21 extends along the surface of the posts 17 and half posts 17' from a point, adjacent to the point at which the concave surface 20 terminates below the plane of the periphery, downward to a point substantially half way between the bottom of the egg pockets 11 (second plane) and the plane of the periphery. It is noted that the ridges 21 could extend substantially to the bottom of the egg pocket 11 (second plane) if desired. Any suitable width for the ridges 21 may be utilized but preferably the width is such that, if a small egg is supported entirely by the four of the ridges 21 in the egg pocket, the pressure on the egg will not be such as to cause breakage and leaking.

Figure 4:
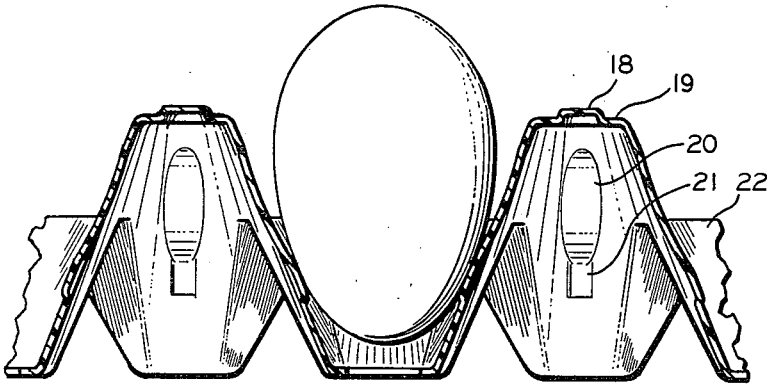
FIG. 4 is a cross sectional view, taken along line A—A of FIG. 2, of an egg pocket containing a small egg.

As is illustrated in FIG. 4, for a small egg the ridges 21 provide essentially only 4 point contact between the egg and the egg supporting tray thus providing a minimum region for water to be retained at the points of contact and water spotting is essentially completely eliminated. Also washing of the small eggs is facilitated due to the improved circulation of water around the eggs and drying is facilitated by the improved circulation of air.

Figure 3:
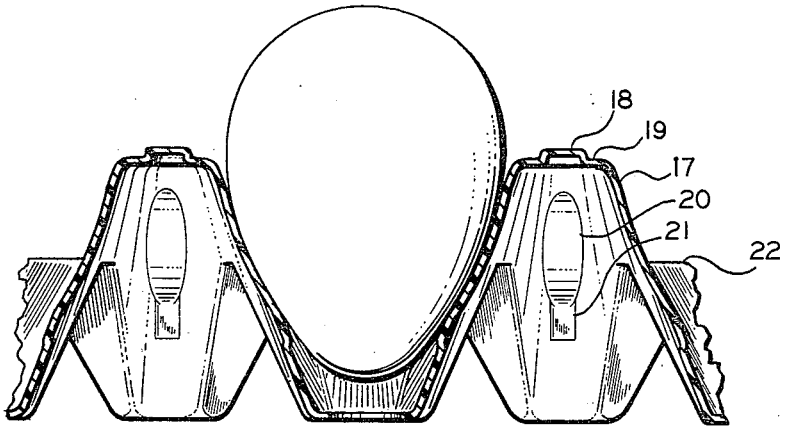
FIG. 3 is a cross sectional view, taken along line A—A of FIG. 2 of an egg pocket containing a large egg.

For larger eggs, the contact area is increased, as is illustrated in FIG. 3, but the large egg is seated low enough in the egg pocket to prevent breakage when trays are stacked. The larger area of contact is less desirable then the four point contact provided by the ribs 21 but it is more desirable to increase the contact area than to incur the expenses which would be involved in increasing the size of the egg supporting tray to accommodate larger eggs without breakage. Thus, the egg supporting tray of the present invention may be utilized to support smaller eggs with the advantages of four ridge support and may also be utilized to support larger eggs without changing the size of the egg supporting tray.

As has been previously stated, each egg pocket 11 preferably has a hole 12 in the bottom thereof. However, in large produce houses where thousands of eggs are handled daily there is inevitably some cracking and breakage of the handled eggs. Cracked eggs which cannot be sold in regular commerce for future use are customarily shipped to dehydrating or other processing plants for immediate use. If leaking eggs are being shipped, it is desirable to close the bottom of the egg pockets 11. The thus closed bottoms of the egg pockets 11 are preferably concave in the general shape of the end of an egg.

If the drainage holes 12 are present, then knobs 18 on the tapered posts 17 should register with and extend into the drainage holes 12 of the tray above when the trays are stacked so as to provide maximum support for the stacked trays. The upper tray is rotated 90 degrees with respect to the lower tray thus bringing the knobs 18 on the five posts 17 in each column of the post on the lower tray into register with the 5 drainage holes 12 in each row of egg pockets 11 in the upper tray. Thus, the upper ends of the eggs are positioned within the hollow downward facing interior of the posts 17 on the upper tray and the lower ends of the eggs are positioned in the egg pocket 11 and the four posts adjacent thereto in the lower tray. As has been previously stated, the hole 12 is not essential. If the hole 12 is not present, it may be desirable to delete the knob 18 to provide a larger surface on which the egg trays may be stacked.

Each tray is formed to hold a definite number of eggs, for example 30, and the periphery or rim of the tray can be formed of cutout portions 23 on two sides thereof. The cut out portions 23 serve as finger openings, allowing each tray to be grasped on its edges for convenient handling thereof. Also the ridges 25 help to keep stacked egg supporting trays separated which further facilitates handling of the egg supporting trays.

The top surface of the knobs 18 may be flat, as illustrated in FIG. 1, or may be concave. The use of a concave top surface may prevent a small egg from contacting the knob 18 projecting through a hole 12.

The egg supporting tray 10 can be fabricated from any suitable material. Preferably, the egg supporting tray is formed from polyethylene. Also, the egg supporting tray can be fabricated by any suitable means. The known process of vacuum forming is preferably utilized to form the tray 10 from polyethylene sheet.

Reasonable variations in modifications are possible within the scope of the disclosure and the appended claims to the invention.

That which is claimed is:

1. An egg supporting tray comprising:

a plurality of equidistantly spaced hollow posts arranged in equidistantly spaced parallel rows and equidistantly spaced parallel columns transverse to said rows, wherein the apexes of said plurality of posts are in a first plane and the bases of said plurality of posts are in a second plane and wherein a plurality of egg pockets are formed by said plurality of posts;

a concave surface, on each one of the surfaces of said plurality of posts which form a part of an egg pocket, extending from a point close to but below said first plane to a point close to but below a third plane which is parallel to the first and second planes and which extends through a midportion of said plurality of posts, wherein the direction of concavity is towards the center of said posts and each concave surface has substantially the curvature of a side portion of an egg; and an elongated ridge, on each one of the surfaces of said plurality of posts which form a part of an egg pocket, extending from the end of said concave surface which is below said third plane to a point above the said second plane, wherein each elongated ridge is substantially perpendicular to said third plane except for any slope in the surface of said posts with respect to said third plane and wherein each elongated ridge projects outwardly from the surface of said posts.

2. An egg supporting tray in accordance with claim 1 additionally comprising a plurality of ribs arranged in said parallel rows and said parallel columns so as to interconnect said plurality of posts, wherein each rib extends from said third plane to said second plane.

3. An egg supporting tray in accordance with claim 2 wherein said posts are substantially frustoconical.

4. An egg supporting tray in accordance with claim 3 wherein said third plane is substantially equidistantly spaced from said first and second plane.

5. An egg supporting tray in accordance with claim 4 wherein each one of said plurality of ribs is a tapered rib, with respect to the center of said egg pocket, having the narrower portion at said third plane and the wider portion at said second plane.

6. An egg supporting tray in accordance with claim 5 wherein each elongated ridge terminates at a point substantially equidistant from said second and third planes.

* * * * *